US005701988A

United States Patent [19]

Tsukada

[11] Patent Number: 5,701,988

[45] Date of Patent: Dec. 30, 1997

[54] COIN-OPERATED LOCKER

[75] Inventor: Kazuo Tsukada, Kanagawa, Japan

[73] Assignee: Alpha Corporation, Kanagawa, Japan

[21] Appl. No.: 526,562

[22] Filed: Sep. 12, 1995

[30] Foreign Application Priority Data

Sep. 21, 1994 [JP] Japan ..... 6-226837

[51] Int. Cl.[6] ..... G07F 17/12

[52] U.S. Cl. ..... 194/241; 70/DIG. 41

[58] Field of Search ..... 194/241, 242, 194/239, 70; 70/DIG. 41

[56] References Cited

U.S. PATENT DOCUMENTS 4,773,020 9/1988 Anderson et al. ..... 364/464.01

FOREIGN PATENT DOCUMENTS 2726908 8/1978 Germany ..... 194/239
52-52698 4/1977 Japan ..... 194/242
3-214298 9/1991 Japan .
43 05 843 A1 8/1993 Japan .
5-258177 10/1993 Japan .
6-20154 1/1994 Japan .
2 269 469 2/1994 United Kingdom .

*Primary Examiner*—F. J. Bartuska
*Attorney, Agent, or Firm*—Nikaido Marmelstein Murray & Oram LLP

[57] ABSTRACT

A coin-operated locker includes a control section for controlling a lock mechanism so as to permit locking of the locker upon insertion of a coin and permit insertion of a coin and prohibit locking of the locker upon unlocking of the locker and a timer for measuring a predetermined time interval. The control section controls a timer to start operation after a coin-operated locker has been locked. The control section further monitors measurement by the timer and controls so as to permit the insertion of coins and prohibit the locking of the locker when the measurement by the timer has been completed and the locker has therefore been unlocked.

6 Claims, 5 Drawing Sheets

COIN-OPERATED LOCKER

BACKGROUND OF THE INVENTION

The invention relates to a coin-operated locker that locks the locker after coins have been inserted.

A conventional coin-operated locker stands ready for use in a vacant condition obtained by rotating to unlock a lock mechanism with the key being inserted into the lock mechanism. Under the vacant condition, coins can be inserted, and the locker cannot be locked unless the coins are inserted.

Such a coin-operated locker is used in the following manner. First, the door of a coin-operated locker is opened to put the baggage in the chamber. Then, the door is closed and coins amounting to a predetermined charge are inserted from a coin insertion slot. When the key is rotated to lock the lock mechanism and thereafter pulled out, the coin-operated locker is in use.

To take the baggage out of the coin-operated locker, the key is inserted into the lock mechanism of the coin-operated locker and rotated to unlock the lock mechanism, so that the lock mechanism is unlocked. The coin-operated locker is put in the vacant condition at this instance.

However, when the user may become aware that there is some additional baggage to be put in the locker or that some portion of the baggage must be taken out of the locker after the coin-operated locker has been put in use by pulling the key out, the user has to open the coin-operated locker again. It is common that the user disadvantageously becomes aware of having to open the locker when he or she is somewhat remote from where the coin-operated locker is installed. Even in this case, the coin-operated locker is put in the vacant condition again once the key is inserted to unlock the lock mechanism. This has imposed the problem that coins amounting to a predetermined charge must be inserted again to lock the coin-operated locker.

SUMMARY OF THE INVENTION

The object of the invention is, therefore, to provide a coin-operated locker capable of re-locking the lock mechanism without re-inserting coins once the coin-operated locker has been in use.

To achieve the above object, the invention is applied to a coin-operated locker having a control means for controlling a lock mechanism so as to permit the locking of the locker upon insertion of a coin and permit the insertion of a coin and prohibit the locking of the locker upon unlocking of the locker. In such coin-operated locker, a timer for measuring a predetermined time interval is provided, and the control means starts the timer upon locking of the locker, monitors measurement by the timer, and permits the insertion of a coin and prohibits the locking of the locker upon completion of the measurement by the timer and subsequent unlocking of the locker.

Further, it is preferred that the operation of permitting the insertion of a coin and the operation of prohibiting the locking of the locker be interlocked through a solenoid means.

In the coin-operated locker of the invention, a predetermined time interval is set to the timer, and the timer measures this predetermined time interval. The control means starts the timer upon locking of the locker, monitors the measurement by the timer, and permits the insertion of coins and prohibits the locking of the locker upon completion of the measurement by the timer and subsequent unlocking of the locker. Therefore, until the measurement by the timer is completed, the locker can be unlocked and locked without re-inserting coins even after the locker has been locked and the key has therefore been pulled out.

DETAILED DESCRIPTION OF PREFERRED EMBODIMENT

An embodiment of the invention will now be described with reference to FIGS. 1 to 6.

Figure 3:
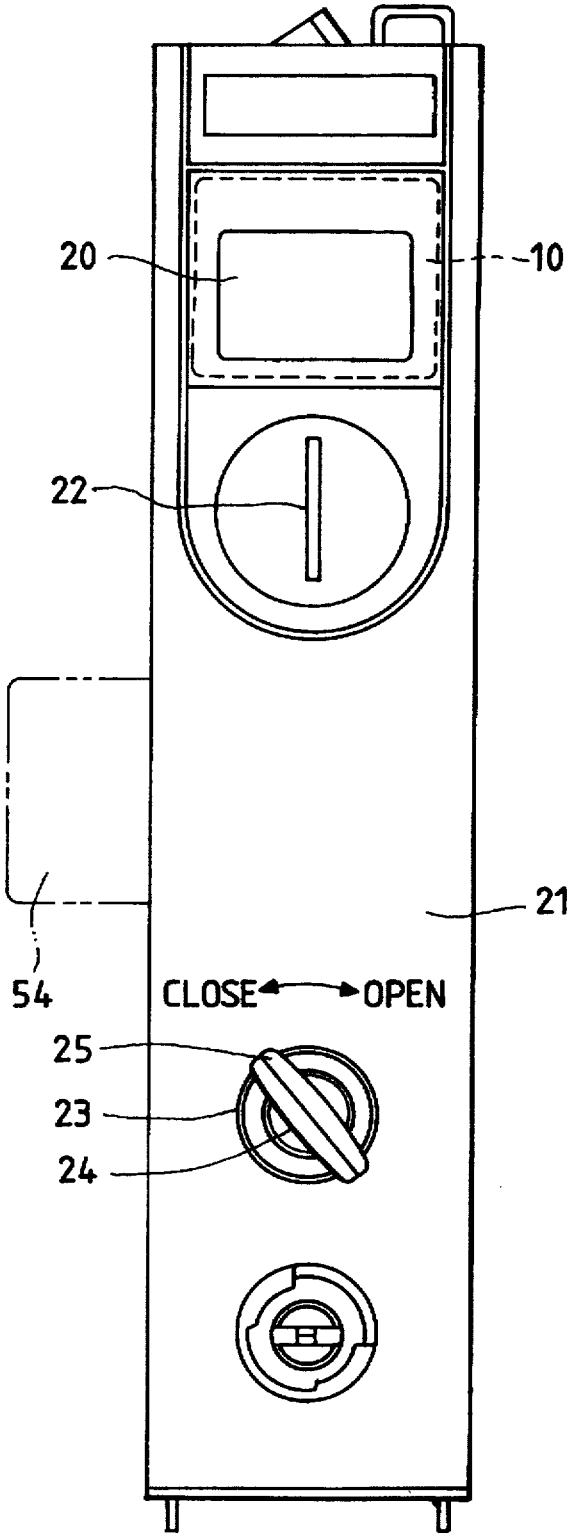
FIG. 3 is a front view of a lock mechanism of a coin-operated locker in the embodiment of the invention.

FIG. 3 is a front view of a lock mechanism of a coin-operated locker, which is the embodiment of the invention. This lock mechanism is specially designed to be unlocked and locked without re-inserting coins even after the lock mechanism has been locked and a key 25 has thereafter been pulled out.

In FIG. 3, an LCD 20, a coin insertion slot 22, and a cylinder lock 23 are arranged on a front plate 21 of the lock mechanism. The LCD 20 functions as a display window for displaying a basic charge and the like. The coin insertion slot 22 allows the user to insert coins thereinto before using the locker. The cylinder lock 23 has a key insertion slot 24. Inside the lock mechanism incorporates is a controller 10. The controller 10 controls coin insertion and keying operation. When the coin-operated locker is not in use, i.e., under the vacant condition, the key 25 is kept inserted into the key insertion slot 24 as shown in FIG. 3.

Figure 4:
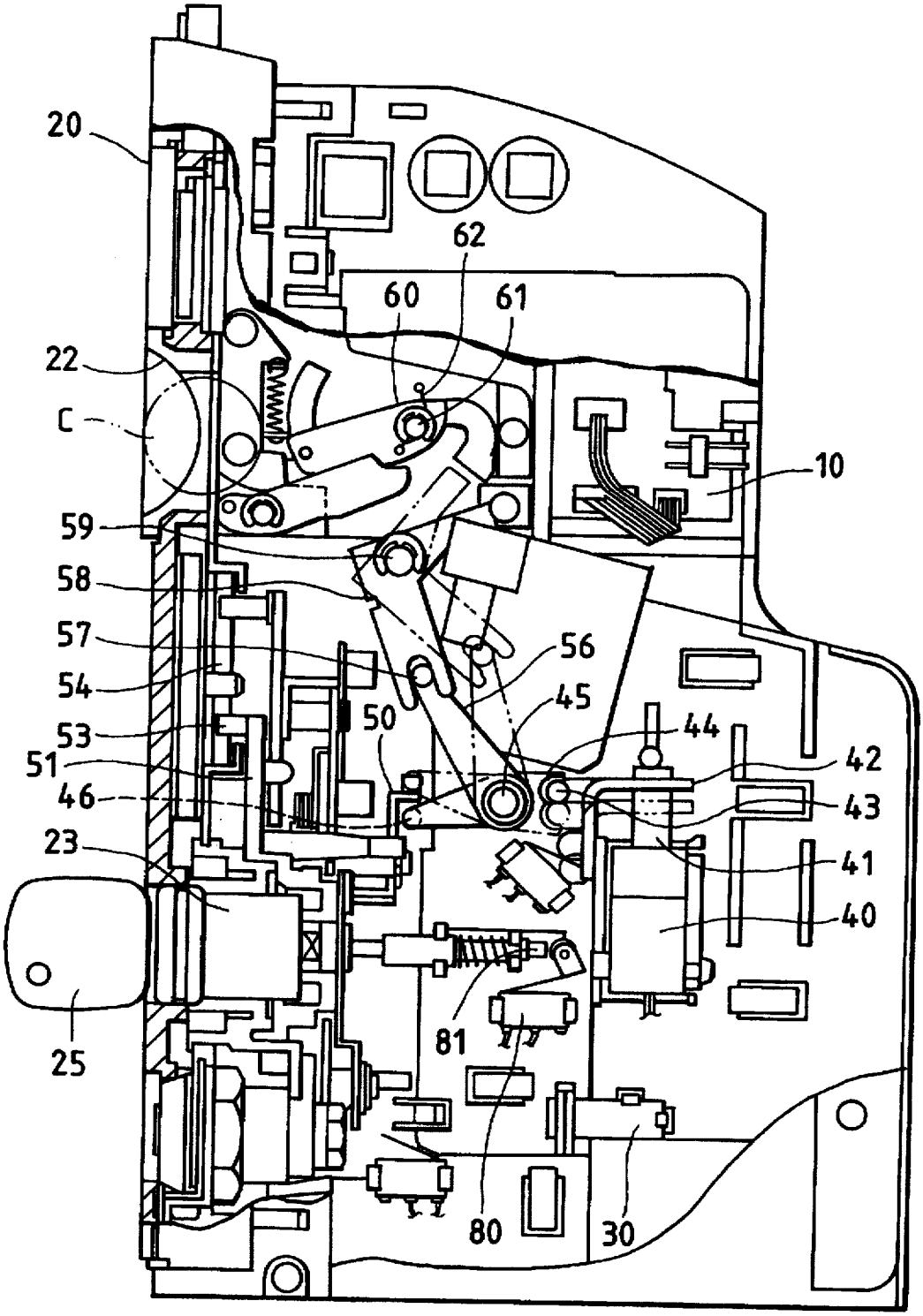
FIG. 4 is a longitudinal side sectional view of the lock mechanism portion in the embodiment of the invention.
Figure 5:
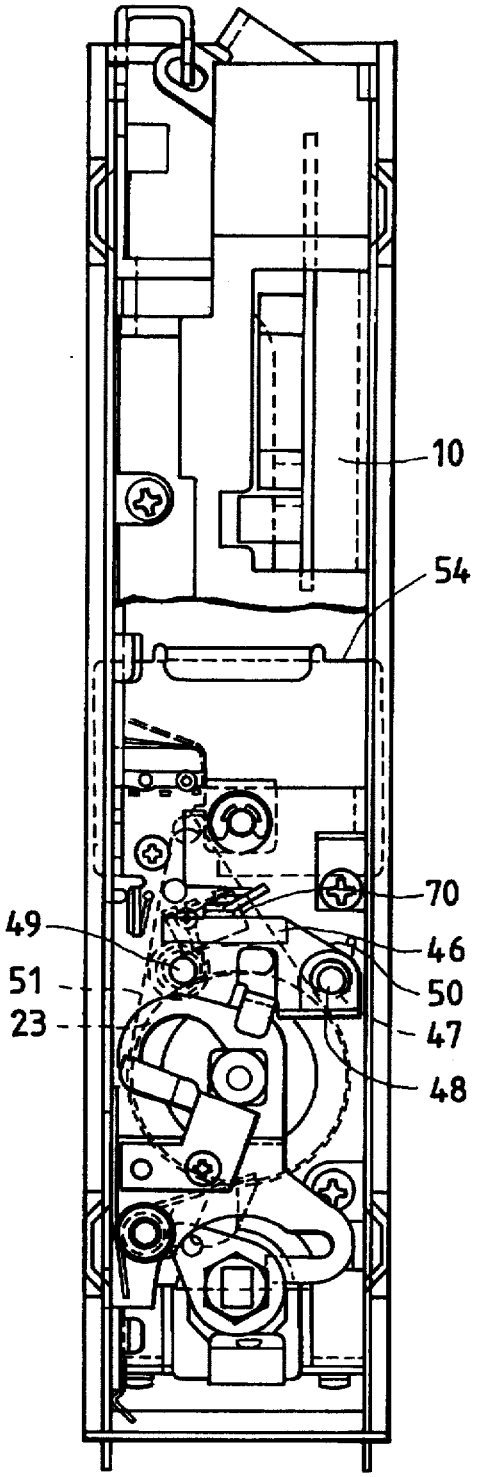
FIG. 5 is a longitudinal back sectional view showing the lock mechanism portion in the unlocked condition in the embodiment of the invention.
Figure 6:
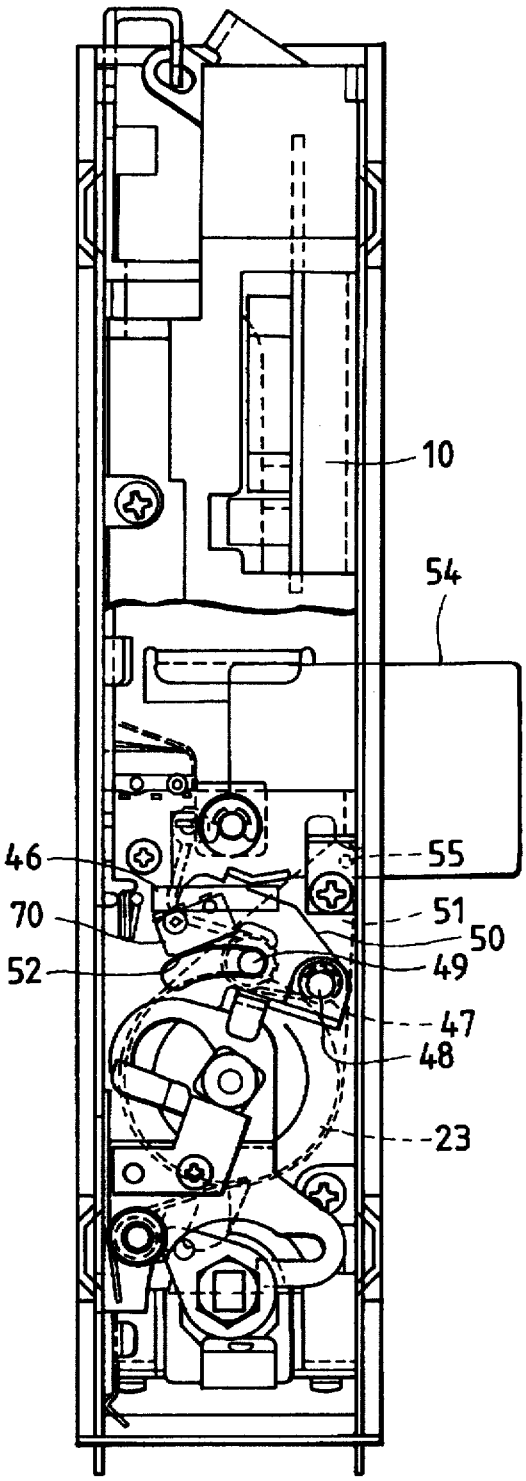
FIG. 6 is a longitudinal back sectional view showing the lock mechanism in the locked condition in the embodiment of the invention.

FIG. 4 is a longitudinal side sectional view of the lock mechanism; FIG. 5 is a longitudinal back sectional view showing the unlocked condition of the lock mechanism; and FIG. 6 is a longitudinal back sectional view showing the locked condition of the lock mechanism. In FIGS. 4, 5, and 6, the lock mechanism has a photointerrupter 30, a solenoid means 40, a lock/unlock detection switch 70, and a key insertion/disinsertion detection switch 80. The photointerrupter 30 detects the insertion of a coin C. The solenoid means 40 has a vertically movable core portion 41 that is a drive means for permitting/prohibiting the rotation of the key 25 and permitting/prohibiting the insertion of the coin C. The lock/unlock detection switch 70 detects the locking and unlocking of the lock mechanism. The key insertion/disinsertion detection switch 80 detects the insertion and disinsertion of the key 25.

The photointerrupter 30 includes an LED (light-emitting diode) and a phototransistor, both of which interpose a passage along which a coin passes. The LED emits light upon conduction, and the phototransistor detects the shielding of the light by a passing coin. The detected signal is delivered to the control section, which counts the number of coins.

The solenoid means 40 holds one of two stable states in response to a signal from the control section 10. That is, the solenoid means 40 holds either a locked condition in which the rotation of the cylinder lock 23 is prohibited (the upwardly moved position of the core portion of the solenoid; a portion related to the upwardly moved position is indicated by a solid line) and an unlocked condition in which the rotation of the cylinder lock 23 is permitted (the downwardly moved position of the core portion of the solenoid; a portion related to the downwardly moved position is indicated by a chain line).

By the upward movement of the core portion 41 of the solenoid 40, an interlocking lever 44 engaged with an arm member 42 mounted on top of the core portion 41 through a pin 43 is rotated counterclockwise about a shaft 45, so that a pin 46 gets lowered (see FIG. 5). The lowering of the pin 46 idles a lever 50 that is engaged with a pin 49 while urged counterclockwise about a shaft 48 by a spring 47, thereby causing the lever 50 to be engaged with the pin 49 fixed to a lever 51 that rotates integrally with the cylinder lock 23 (this condition is shown in FIG. 5).

The pin 49 is designed to move between the leftmost unlock position and the rightmost lock position within an arcuate hole portion 52. However, when the lever 50 is kept engaged with the pin 49 as described above, the cylinder lock 23 set to the unlock position (the leftmost position) is not permitted to rotate to be locked (see FIG. 5). It may be noted that since a pin 53 on top of the lever 51 is engaged with a notched portion 55 of a lock plate 54, the lock plate 54 is projected sideways to be engaged with a not shown locker door to thereby keep the locker door closed under the locked condition shown in FIG. 6.

Further, by the upward movement of the core portion 41 of the solenoid 40, an arm member 56 fixed to the interlocking lever 44 is rotated counterclockwise about the shaft 45. The rotation of the arm member 56 causes a substantially L-shaped arm member 58 engaged with a pin 57 on top of the arm member 56 to rotate clockwise about a shaft 59. The rotation of this L-shaped arm member 58 allows a coin insertion block lever 60 to rotate about a shaft 61, the lever 60 confronting the top of the L-shaped arm member 58. Since this coin insertion block lever 60 is urged counterclockwise by a coil spring 62, the coin insertion block lever 60 is allowed to rotate clockwise when a coin C is inserted into the coin insertion slot 22 resisting this urging force. Therefore, the insertion of the coin C is permitted. The upward movement of the core portion 41 of the solenoid 40 implements both the regulation of the cylinder lock 23 from rotating to be locked and the permission of the insertion of a coin C in synchronism.

On the other hand, the downward movement of the core portion 41 of the solenoid 40 causes the interlocking lever 44 engaged with the arm member 42 mounted on top of the core portion 41 to rotate clockwise about the shaft 45, thereby raising the pin 46 on top thereof. The raising of the pin 46 engages the lever 50 therewith, the lever 50 being urged counterclockwise about the shaft by the spring 47, and the arcuate hole portion 52 is in turn exposed by rotating the lever 50 clockwise. It is in this way that the cylinder lock 23 set to the lock position can be rotated to be unlocked (see FIG. 6).

Further, the downward movement of the core portion 41 of the solenoid 40 causes the arm member 56 fixed to the interlocking lever 44 to rotate clockwise about the shaft 45. The rotation of the arm member 56 causes the substantially L-shaped arm member 58 to rotate counterclockwise about the shaft 59, the arm member 58 being engaged with the pin 57 on top of the arm member 56. The rotation of the L-shaped arm member 58 causes an end of the coin insertion block lever 60 to meet an end of the L-shaped arm member 58 and therefore regulates the rotation of the coin insertion block lever 60 about the shaft 61. Therefore, the insertion of the coin C is prohibited. The lock/unlock detection switch 70 is constructed of a microswitch. This microswitch 70 detects the locked condition as well as the unlocked condition by opening and closing a contact when the pin 49 is moved along the arcuate hole portion 52.

The key insertion/disinsertion switch 80 is also constructed of a microswitch. This microswitch 80 detects the insertion of the key 25 by opening and closing a contact through a rod 81 that advances in response to the insertion of the key 25 and retreats in response to the pulling out of the key 25.

Figure 1:
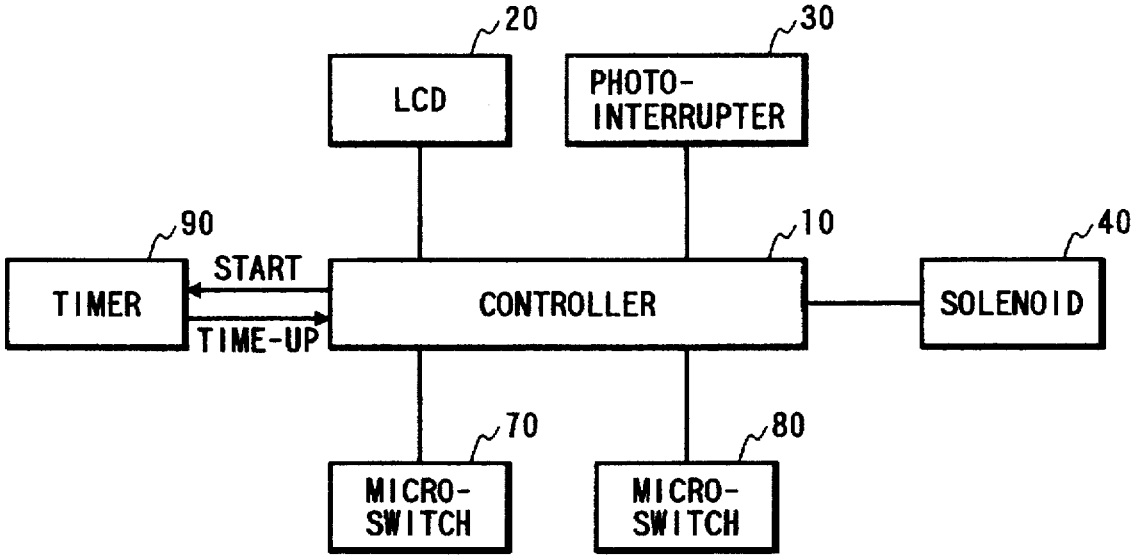
FIG. 1 is a block diagram of an embodiment of the invention.

FIG. 1 is a block diagram of the embodiment of the invention. The control means 10 is constructed of a microcomputer including a RAM, a ROM, an I/O port, and the like, which are not shown in the drawing, and controls various parts based on a control program as will be described later. The LCD 20, the photointerrupter 30, the solenoid 40, the microswitches 70 and 80, and the timer 90 are connected to the I/O port of the controller 10.

Figure 2:
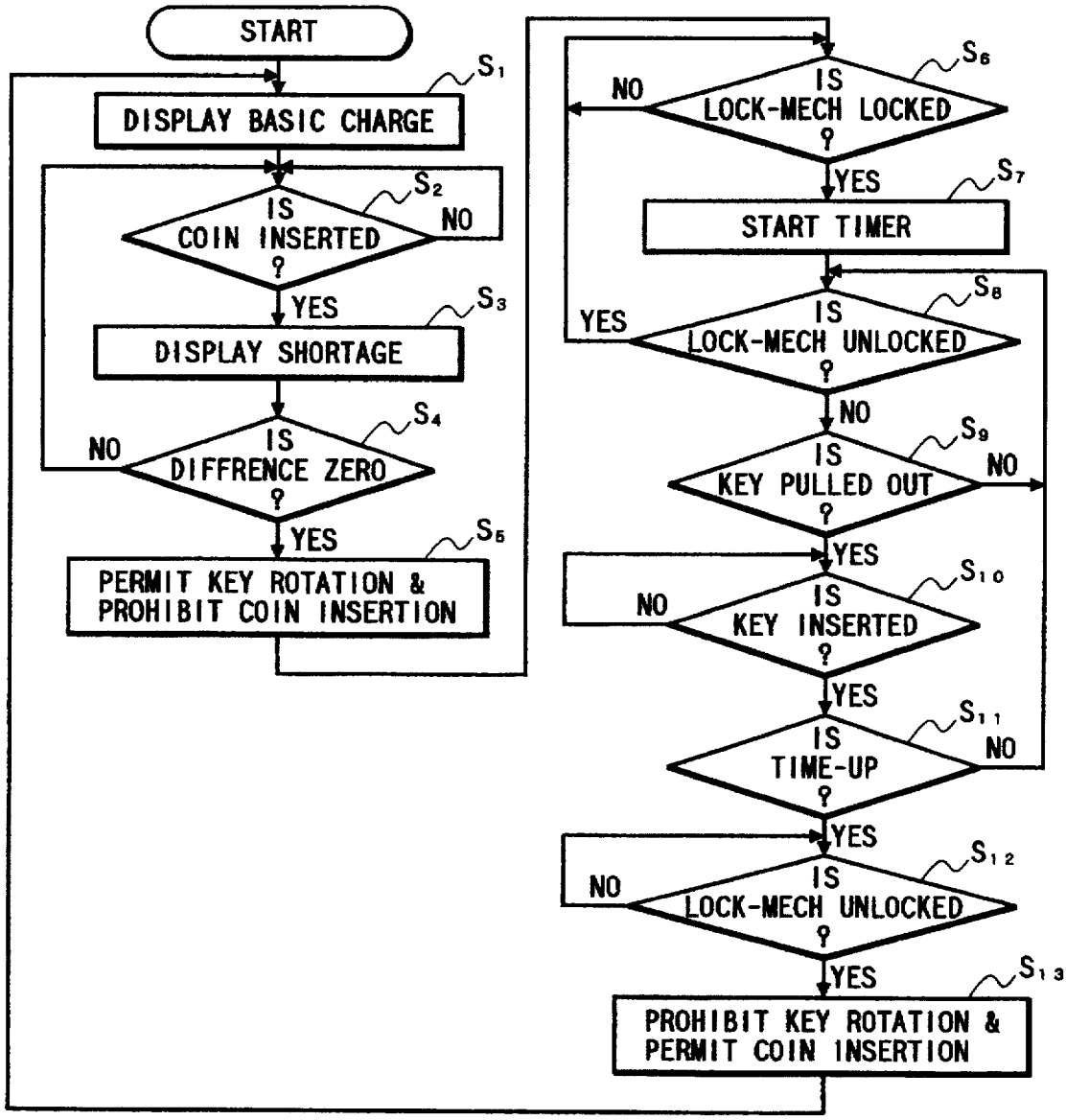
FIG. 2 is a flowchart showing a control flow of a control section in the embodiment of the invention.

FIG. 2 is a flowchart showing the control flow of the control section 10. The operation of the control section 10 will be described with reference to FIG. 2.

Upon start of the control program, the basic charge is displayed on the LCD 20 (Step 1).

The control section 10 is on standby until coins C are inserted while monitoring the insertion of the coins C with the photointerrupter 30 (Step 2).

When the coins C have been inserted, a difference between the total amount of money inserted and the basic charge is displayed on the LCD 20 in accordance with how many coins have been inserted (Step 3).

The control section 10 determines whether the difference is zero or not and waits until the difference becomes zero (Step 4). When the difference equals zero, the solenoid 40 is lowered to not only permit the rotation of the key 25 to lock the lock mechanism, but also prohibit the insertion of coins C (Step 5).

The control section 10 determines whether or not the lock mechanism is locked by detecting the opening/closing of the microswitch 70. If the lock mechanism has been locked, a timer 90 start signal is output. If the lock mechanism has not been locked, the control section 10 stands by (Step 6).

If the lock mechanism has been locked, the control section 10 starts the timer 90 based on the timer 90 start signal after resetting the timer 90 (Step 7).

The control section 10 determines whether or not the lock mechanism is unlocked by detecting the opening/closing of the microswitch 70 (Step 8). If the lock mechanism has been unlocked, the control section 10 returns to Step 6 to determine whether or not the lock mechanism is locked by detecting the opening/closing of the microswitch 70. If the lock mechanism has been locked, a timer 90 start signal is output.

If the lock mechanism has not been unlocked, the control section 10 determines whether or not the key 25 is pulled out by detecting the opening/closing of the microswitch 80 (Step 9). If the key 25 has not been pulled out, the control section 10 returns to Step 8 to determine whether or not the lock mechanism is unlocked by detecting the opening/closing of the microswitch 70.

If the key has been pulled out, the control section 10 determines whether or not the key 25 is inserted by detecting the opening/closing of the microswitch 80, and waits until the key 25 is inserted (Step 11).

If the key 25 has been inserted, the control section 10 checks the predetermined time interval and determines whether or not such a timed interval has ended (Step 11). If the timed interval has not ended, then the control section 10 returns to Step 8 to determine whether or not the lock mechanism is unlocked by detecting the opening/closing of the microswitch 70. If the lock mechanism has unlocked, the control section 10 returns to Step 6 to determine whether or not the lock mechanism is locked by detecting the opening/closing of the microswitch 70. If the lock mechanism has been locked, the control section 10 outputs a timer start signal, and starts the timer 90 again after resetting the timer 90 in Step 7.

If the timed interval has ended, the control section 10 determines whether or not the lock mechanism is unlocked by detecting the opening/closing of the microswitch 70, and waits until the lock mechanism is unlocked (Step 12). If the lock mechanism has been unlocked, the control section 10 raises the solenoid 40 to not only prohibit the rotation of the key 25 to lock the lock mechanism but also permit the insertion of coins C (Step 13).

Even if the key 25 is inserted again after the coin-operated locker is locked and the key 25 has thereafter been pulled out, the lock mechanism is permitted to be locked again without inserting coins C until the predetermined time interval elapses from the start of the timer 90.

If it is so arranged that the timer 90 is reset and then started from zero in Step 7 after the lock mechanism has been locked as described above (i.e., if the timer 90 is started always from zero), then the lock mechanism can be locked again without inserting coins C until the predetermined time interval (e.g., 10 minutes) elapses again from the re-starting of the timer 90. In other words, when the lock mechanism is unlocked and locked at least once before the predetermined time interval elapses from the start of the timer after the lock mechanism has been locked, the lock mechanism can be locked without inserting coins C no matter how much time has elapsed.

The timer 90 may be arranged at the start of the timer in Step 7 in such a manner that: the timer 90 is reset and then started from zero immediately after the lock mechanism has been locked for the first time in Step 6; a step for temporarily stopping the timer 90 between Steps 10 and 11 is taken; and the timer 90 is re-started from the temporary stoppage after the lock mechanism has been locked for the second time and onward. In this arrangement, the control section jumps to Step 12 when the elapsed time exceeds a predetermined time interval (e.g., 10 minutes), so that the re-locking of the lock mechanism is no longer permitted once the predetermined time interval has elapsed.

As is apparent from the foregoing description, the coin-operated locker of the invention is characterized as providing a timer for measuring a predetermined time interval, and causing a control means to start the timer upon locking of the locker, monitor measurement by the timer, and permit the insertion of a coin and prohibit the locking of the locker upon completion of the measurement by the timer and subsequent unlocking of the locker in the coin-operated locker having the control means for controlling a lock mechanism so as to permit the locking of the locker upon insertion of a coin and permit the insertion of a coin and prohibit the locking of the locker upon unlocking of the locker. Therefore, the re-locking of the coin-operated locker is permitted without re-inserting coins once the locker has been put in use with the key pulled out after rotated to lock the lock mechanism.

What is claimed is:

1. A coin-operated locker comprising:

a lock mechanism;

a timer for measuring a predetermined time interval: and a control means for controlling said lock mechanism so as to permit locking of the lock mechanism when a coin is inserted, and to permit repeated locking and unlocking of the lock mechanism if the predetermined time interval has not elapsed;

wherein the control means statics the timer when the lock mechanism is locked, monitors measurement by the timer, and permits the insertion of a coin and prohibits the locking of the lock mechanism when the measurement by the timer is completed and the lock mechanism is subsequently unlocked, wherein the operation of permitting the insertion of a coin and the operation of prohibiting the locking of the locker are interlocked through a solenoid means.

2. A coin operated locker according to claim 1, further comprising:

a coin sensor for detecting an insertion of coins;

a lock/unlock detector for detecting the locking and unlocking of the lock mechanism;

a key insertion/disinsertion detector for detecting the insertion and disinsertion of a key into the lock mechanism;

a drive means for permitting/prohibiting the rotation of the key and for permitting/prohibiting the insertion of the coin.

3. A coin-operated locker comprising;

a lock mechanism;

a timer for measuring a predetermined time interval; and a control means for controlling said lock mechanism so as to permit locking of the lock mechanism when a coin is inserted, and to permit repeated locking and unlocking of the lock mechanism if the predetermined time interval has not elapsed;

wherein the control means starts the timer when the lock mechanism is locked, monitors measurement by the timer, and permits the insertion of a coin and prohibits the locking of the lock mechanism when the measurement by the timer is completed and the lock mechanism is subsequently unlocked, wherein if the lock mechanism is unlocked before the measurement by the timer is completed, the control means reset and restarts the timer when the lock mechanism is again locked.

4. A coin operated locker according to claim 3, further comprising:

a coin sensor for detecting an insertion of coins;

a lock/unlock detector for detecting the locking and unlocking of the lock mechanism;

a key insertion/disinsertion detector for detecting the insertion and disinsertion of a key into the lock mechanism;

a drive means for permitting/prohibiting the rotation of the key and for permitting/prohibiting the insertion of the coin.

5. A coin-operated locker comprising:

a lock mechanism;

a timer for measuring a predetermined time interval; and a control means for controlling said lock mechanism so as to permit locking of the lock mechanism when a coin is inserted, and to permit repeated locking and unlocking of the lock mechanism if the predetermined time interval has not elapsed;

wherein the control means starts the timer when the lock mechanism is locked, monitors measurement by the timer, and permits the insertion of a coin and prohibits the locking of the lock mechanism when the measurement by the timer is completed and the lock mechanism is subsequently unlocked, wherein if the lock is unlocked before the measurement by the timer is completed, the control means suspend the measurement of the timer.

6. A coin operated locker according to claim 5, further comprising:

a coin sensor for detecting an insertion of coins;

a lock/unlock detector for detecting the locking and unlocking of the lock mechanism;

a key insertion/disinsertion detector for detecting the insertion and disinsertion of a key into the lock mechanism;

a drive means for permitting/prohibiting the rotation of the key and for permitting/prohibiting the insertion of the coin.

* * * * *